US006290565B1

(12) United States Patent
Galyean III et al.

(10) Patent No.: US 6,290,565 B1
(45) Date of Patent: Sep. 18, 2001

(54) INTERACTIVE GAME APPARATUS WITH GAME PLAY CONTROLLED BY USER-MODIFIABLE TOY

(75) Inventors: Tinsley A. Galyean III; Henry Kaufman, both of Cambridge; Bruce M. Blumberg, Pepperell; David C. O'connor, Cambridge, all of MA (US)

(73) Assignee: Nearlife, Inc., Cambridge, MA (US)

( * ) Notice: Subject to any disclaimer, the term of this patent is extended or adjusted under 35 U.S.C. 154(b) by 0 days.

(21) Appl. No.: 09/357,725

(22) Filed: Jul. 21, 1999

(51) Int. Cl.[7] ..... A63F 9/24
(52) U.S. Cl. ..... 446/99; 463/36; 273/148 B
(58) Field of Search ..... 463/1, 36, 37, 463/47, 48, 39; 273/237, 148 B, 238; 446/100, 99; 434/307, 307 R, 308

(56) References Cited

U.S. PATENT DOCUMENTS 4,710,873 * 12/1987 Breslow et al. .
4,712,184 * 12/1987 Haugerud .
4,841,291 * 6/1989 Swix et al. .
4,869,701 * 9/1989 Kawai et al. .
5,636,994 * 6/1997 Tong .
5,655,945 * 8/1997 Jani .
5,692,956 * 12/1997 Rifkin .
5,697,829 * 12/1997 Chainani et al. .
5,713,792 * 2/1998 Ohzono et al. .
5,733,131 * 3/1998 Park .
5,741,182 * 4/1998 Lipps et al. .
5,746,602 * 5/1998 Kikinis .
5,752,880 * 5/1998 Gabai et al. .
5,766,077 * 6/1998 Hongo .
5,833,549 * 11/1998 Zur et al. .
5,853,327 * 12/1998 Gilboa .
5,855,483 * 1/1999 Collins et al. .
5,860,861 * 1/1999 Lipps et al. .
5,951,404 * 9/1999 Oishi et al. .
5,976,018 * 11/1999 Druckman .
5,977,951 * 11/1999 Danieli et al. .
6,077,082 * 6/2000 Gibson et al. .
6,106,392 * 8/2000 Meredith .
6,116,906 * 9/2000 Rifkin .

* cited by examiner

*Primary Examiner*—Michael O'Neill
(74) *Attorney, Agent, or Firm*—Kudirka & Jobse, LLP

(57) ABSTRACT

A three dimensional physical toy that can be manipulated by a user is connected to a computer. Interchangeable accessory parts can be plugged into the toy via mechanisms which identify the accessory parts immediately when they are plugged into the toy body. A software program running in the computer displays a graphical character representation of the toy, including the accessory parts that have been plugged into the toy in a virtual environment on a monitor screen. The toy and the accessory parts interact dynamically with the software program so that the graphical character representation of the toy appears on the screen exactly as it physically appears to the user. The toy interacts with the virtual environment in each stage of construction an as each accessory part is added or removed. Therefore, as various accessory parts are inserted into, or removed from, the toy, the graphical character representation of the toy interacts with the virtual environment in different ways. Some of the accessory parts have physical sensors built in to detect motion, bending, etc. These parts can be physically manipulated by the user causing a predetermined action between the graphic character and the virtual environment.

21 Claims, 11 Drawing Sheets

INTERACTIVE GAME APPARATUS WITH GAME PLAY CONTROLLED BY USER-MODIFIABLE TOY

FIELD OF THE INVENTION

This invention relates to an interactive game apparatus in which a three dimensional user-modifiable toy controls a computer generated rendering of the toy in an interactive virtual environment game.

BACKGROUND OF THE INVENTION

Computer games are a very popular form of contemporary entertainment. Many of these computer games display an animated character in a virtual, on-screen environment. Movement and actions performed by the animated character can be controlled by the user and often the character interacts with other characters that are generated by the computer in the virtual environment.

In most conventional games, such a character is controlled either by specialized controllers which are part of the game apparatus that is associated with the computer, or by means of a conventional mouse, keyboard or joystick. When keyboards, mice or joysticks are used to control a character, the possible movement and actions of the character are limited due to the limited nature of these controls. Consequently, the character is often limited to simple actions, such as walking or jumping. The user has no actual physical contact with the character. Therefore, no matter how realistically the character is drawn on the screen, the user can only generally guide the character and cannot actually operate or interact directly with the character.

In order to overcome these difficulties, some conventional systems have associated a three dimensional toy with the computer in such a manner that a user can construct an on-screen character by manipulating interchangeable pieces of the three dimensional toy to physically construct a three dimensional model. The three dimensional model is connected to the computer and each of the interchangeable parts is connected to the toy by means of a coded connection. When the toy is connected to the computer, the computer reads the configuration of the toy and generates an on-screen character whose appearance matches that of the toy. Once the character is generated on screen, the user can then control the character by means of a conventional joy stick or controller. In an alternative embodiment, once the character is constructed, it is controlled solely by the computer and the user merely watches the character interact with other characters and objects in a virtual scene. An example of such a system is shown in U.S. Pat. No. 5,766,077. This system has the advantage in that it allows the user, especially a young user, to manually construct a character that has different characteristics that are chosen by the user during the construction of the toy.

However, with this system, once the graphic representation of the character is drawn on the computer screen, the user is then limited to controlling the character in a conventional manner with the joy stick, keyboard or game controller. Therefore, there is a need for an interactive game in which the user has more direct physical control over the graphical representation of the character on the computer screen.

SUMMARY OF THE INVENTION

In accordance with one illustrative embodiment of the invention, a three dimensional physical toy that can be manipulated by a user is connected to a computer. interchangeable accessory parts can be plugged into the toy via mechanisms which identify the accessory parts immediately when they are plugged into the toy body. A software program running in the computer displays a graphical character representation of the toy, including the accessory parts that have been plugged into the toy in a virtual environment on a monitor screen. The toy and the accessory parts interact dynamically with the software program so that the graphical character representation of the toy appears on the screen exactly as it physically appears to the user.

Furthermore, the toy interacts with the virtual environment in each stage of construction and as each accessory part is added or removed. As various accessory parts are inserted into, or removed from, the toy, the graphical character representation of the toy interacts with the virtual environment in different ways. A user can thus control the interaction between the graphical character and the virtual environment by modifying the physical toy. In addition, the graphical character representation may also be controlled by directly and physically manipulating certain accessory parts which are plugged into the toy.

In accordance with a preferred embodiment, some of the accessory parts have physical sensors built in to detect motion, bending, etc or buttons or other input devices. These parts can be physically manipulated by the user causing a predetermined action between the graphic character and the virtual environment.

In accordance with another embodiment, the toy contains an internal network such that several toys can be plugged together to produce a "cascaded" toy that allows cooperation between the accessory parts plugged into the separate toys.

BRIEF DESCRIPTION OF THE DRAWINGS

The above and further advantages of the invention may be better understood by referring to the following description in conjunction with the accompanying drawings in which.

DETAILED DESCRIPTION OF THE INVENTION

Figure 1:
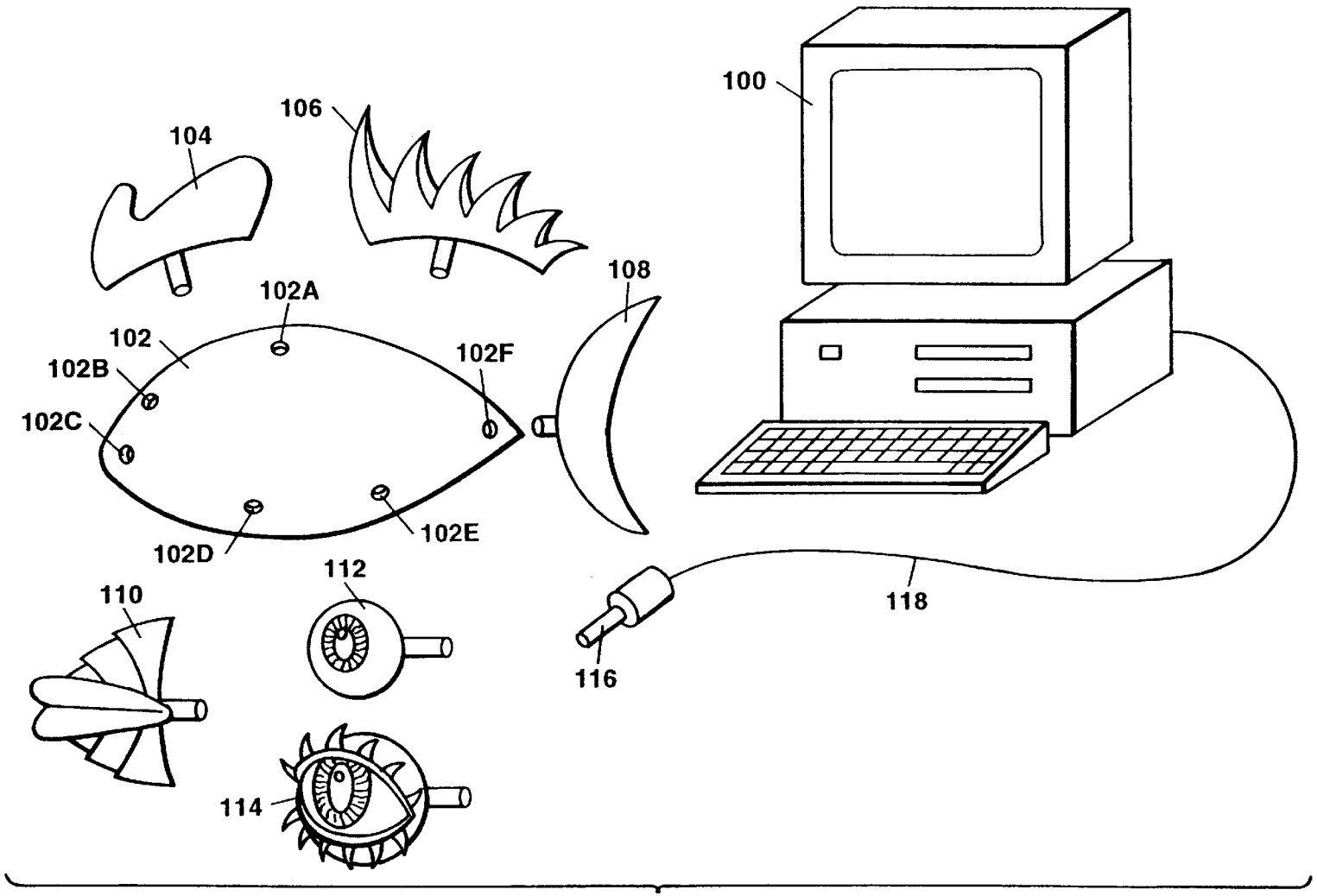
FIG. 1 is an exploded diagram of an illustrative toy connected to a computer with which the toy can interact.

FIG. 1 is an exploded view of the basic parts constituting the present invention. In accordance with the principles of this invention, a computer 100 interacts with a physical toy which comprises a body 102 and a plurality of accessory parts 104–114. The computer 100 operates under control of a software program which generates a graphic character on the display screen constructed in accordance with the configuration of the physical toy. Computer 100 also generates a "virtual environment" in which the constructed character interacts with other graphical characters generated by the computer and with other objects and scenes in the virtual environment. For example, if the virtual environment is an aquarium and the physical toy is a fish, then the virtual environment might include other fish and objects, such as food, plants, etc. with which a fish character controlled by the physical toy can interact. By sensing the type of toy which the user constructs, computer 100 can tailor the virtual environment and the actions of the displayed character to the physical toy. For example, if the physical toy is a fish, then the displayed character will act like a fish no matter which configuration of accessory parts is chosen by the user to construct the physical toy.

Computer 100 might illustratively be a personal computer on which the disclosed interactive game system can be implemented. The exemplary computer system of FIG. 1 is discussed only for descriptive purposes, however, and should not be considered a limitation of the invention. Although the description below may refer to terms commonly used in describing particular computer systems, the described concepts apply equally to other computer systems, including systems having architectures that are dissimilar to a conventional personal computer.

The computer 100 includes a number of conventional components which are not shown for clarity. These can include a central processing unit, which may include a conventional microprocessor, a random access memory for temporary storage of information, and read only memory for permanent storage of information. Mass storage may be provided by diskettes, CD-ROMs, or hard disks. Data and software may be exchanged with client computer 100 via removable media, such as diskettes and CD-ROMs. User input to the client computer 100 may be provided by a number of devices. For example, a keyboard (as shown) and a mouse or joystick may be connected to the computer 100. It should be obvious to those reasonably skilled in the art that other input devices, such as a pen and/or tablet and a microphone for voice input, may be connected to client computer 100. Computer 100 can also includes a network adapter that allows the computer 100 to be interconnected to a network. The network, which may be a local area network (LAN), a wide area network (WAN), or the Internet, may utilize general purpose communication lines that interconnect multiple network devices, each of which performs all, or a portion, of the processing as described below.

Computer system 100 generally is controlled and coordinated by operating system software, such as the WINDOWS 95® operating system (available from Microsoft Corp., Redmond, Wash.). Among other computer system control functions, the operating system controls allocation of system resources and performs tasks such as process scheduling, memory management, networking and I/O services.

In the particular arrangement illustrated in FIG. 1, a fish toy is also illustrated. Fish body 102 can be connected to computer 100 by means of a cable 118 which has a plug 116 at one end. Body 102 has a number of sockets 102A–102F which can accept various plugs. In a preferred embodiment, plug 116 could be inserted into any one of sockets 102A–102F. However, a particular designated socket may also be used. In the latter situation, the plug 116 is physically configured so that it can only be inserted into a predetermined socket. Alternatively, a wireless connection, such as an infrared or radio connection, could also be used without departing from the spirit and scope of the invention. Mechanisms for establishing such wireless connections are well-known.

The fish toy is provided with a plurality of accessory parts 104–114. These may consist of various fins 104 and 106, tails 108, mouth parts 110, and eyes 112 and 114. Each of the accessory parts is provided with a plug mechanism which fits into one of the sockets 102A–102F. The parts are interchangeable in that any part can be inserted into any socket. This allows the user to create various physical toy configurations some of which can resemble real fish and some of which are fanciful creations. The computergenerated graphic characters corresponding to these different physical configurations will interact differently with the virtual environment created within computer 100.

Figure 2:
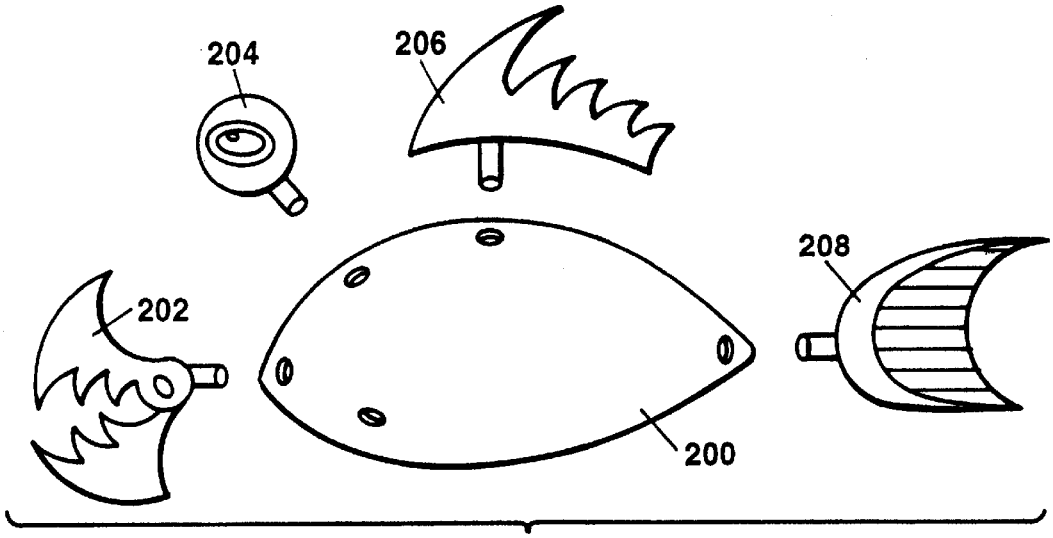
FIG. 2 is illustrative view of a fish toy body with a plurality of associated accessory parts.

In addition, various physical toys may also be used to create different computer-generated characters. The physical accessory parts associated with each of these different physical toys can also be used to control the actions of the associated computer-generated character. For example, as shown in FIG. 2, the fish body used in FIG. 1 is illustrated. The body 200 would have typical accessory parts such as mouth parts 202, eyes 204, fins 206, and tail parts 208. In accordance with a preferred embodiment, the parts 202–208 may have sensors built in so that they can control the operation of the virtual character in the virtual environment constructed by computer 100. For example, tail part 208 may be a thin, flexible membrane which has bend sensors embedded in it. When the tail is bent, the computer can sense the bending movement and cause the graphical character to swim forward. Similarly, mouth parts 202 may have hinged jaws which, when moved, cause the jaws and the character on the computer screen to move. In addition the toy body 102 may be provided with a tilt sensor (not shown) which senses the body position and may be used to detect when a user desires the image of the toy to move.

Figure 3:
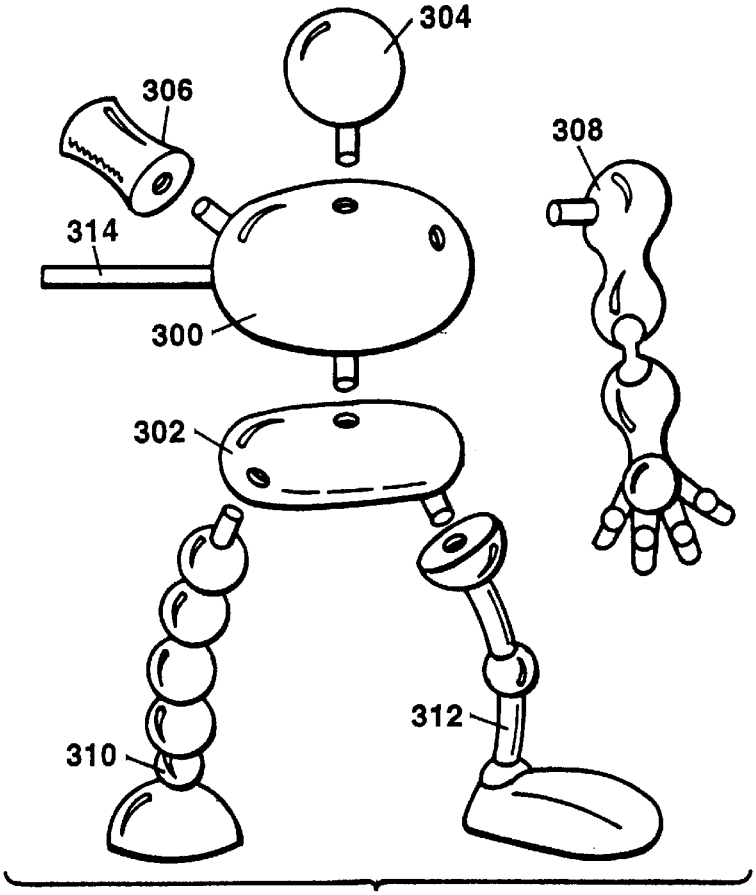
FIG. 3 is a graphical depiction of a robot toy with associated accessory parts.

Alternatively, a different physical toy body can be used. For example, a robot body is illustrated in FIG. 3. Different toy bodies would allow the user to construct different virtual characters on the computer display screen. In FIG. 3 the robot body consists of two parts 300 and 302 which can be plugged together. In accordance with another embodiment, one of the body parts 300–302 can be attached to the computer. However, through the connection between the body parts, information sensed in one body part can be passed through or cascaded with information sensed by the other body part. For example, a cable 314 connected to the computer could be plugged into body part 300. This would allow the computer to sense the presence and configuration of accessory parts which are, in turn, inserted into body 300, for example, arms 306 and 308 and head 304. However, when body part 300 is plugged into body part 302, the computer can also sense, via cable 314, accessory parts plugged into body 302, for example, legs 310 and 312. This arrangement allows an expandable and flexible character to be comprised of a single body or many body parts plugged together. It also allows body parts which are purchased by the user after the initial toy to be used together with existing toy pieces.

The accessory parts of the robot toy may also have embedded sensors which allow movement of the parts to be detected. For example, legs 310 and 312 may have bending sensors that sense movement of the leg parts. When this movement is sensed, the computer 100 may cause the computer-generated graphic character to walk in the virtual environment.

Figure 4:
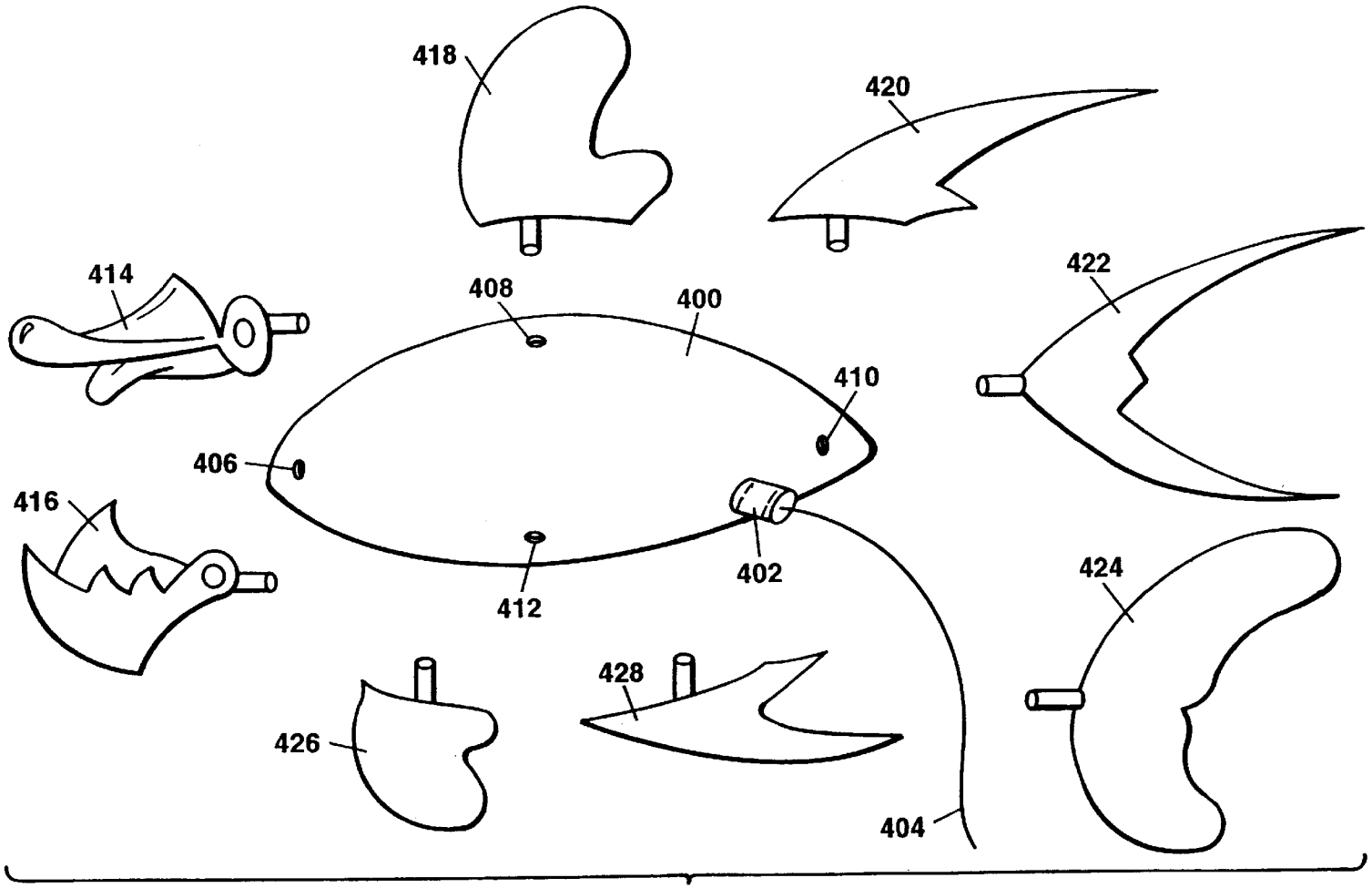
FIG. 4 illustrates the fish toy with a plurality of accessory parts illustrating how various parts can be plugged into various sockets located in the toy body to create a variety of different fish "characters" which interact differently with the virtual environment.

FIG. 4 illustrates how different accessory parts are interchangeable and affect the interaction of the computer-generated character with its virtual environment. A variety of parts can be substituted with each other to create different characters with the same basic parts set. For example, as shown in FIG. 4, body 400 can be connected to the computer, via plug 402 and cable 404. Body 400 has a plurality of sockets 408–412 into which various accessory parts can be plugged. Each accessory part is associated with particular characteristics that cause the composite character to behave in a certain manner. For example, the accessory part set for a fish toy might be provided with two different types of mouth parts. These could include "passive" mouth parts 414 and "aggressive" mouth parts 416. When the passive mouth part 414 is plugged into socket 406, for example, the entire character might act passively, that is move away from other characters, hide, etc. Alternatively, when an aggressive mouth part 416 is plugged into socket 406, the character might act aggressively, that is attack other characters, approach other characters in a threatening manner, etc.

In a similar manner, other body parts might affect the way the virtual character performs within the virtual environment. For example, there may be "slow" fins and "fast" fins. For example, fin 418, when plugged into socket 408, may cause the character to swim forward in a slow, inquisitive manner; whereas, when fin 420 is plugged into socket 408, the character may swim in a much faster manner.

Similarly, tails 422 and 424 may also affect the swimming characteristics of the composite character. In a similar manner, fins 426 and 428 when plugged into socket 412 may also change the characteristics of the character. Of course, the overall characteristics of the character will depend on the exact combination of accessory parts plugged into the body. For example, if mouth parts 414 and fin 420 are plugged into the body 400, this could result in a fast swimming but non-aggressive fish. Alternatively, if mouth parts 416 and fin 418 are added to the body 400, then the result could be an aggressive, but slow moving fish.

In accordance with an important aspect of the present invention, the behavior of the graphical depiction of the character body in the virtual environment immediately changes as accessory parts are added or removed in a dynamic manner. For example, if the user constructed a non-aggressive fish that was being chased by another virtual character on the screen, the user could remove mouth parts 414 and substitute therefore mouth parts 416. This substitution would dynamically change the character of the computer-generated graphic character that then might then turn and aggressively attack its pursuer. Alternatively, the user could substitute a fin 420 for a fin 418 causing the computer-generated character to swim faster and escape its pursuer.

In a similar manner, the character on the screen behaves like the physical toy constructed by the user would behave in its current state. For example, when no accessory parts are plugged into body 400, the computer-generated character would consist of a body that simply sat on the bottom of the virtual environment. When a tail, for example tail 422, is plugged into socket 410, the resulting computer-generated character might swim in a circle. When a fin, such as fin 418, is plugged into socket 408, the resulting fish character might swim in a straight line because the fin is associated with a "steering" behavior. Similarly, the fish character might bump into objects until eyes are added, in which case the fish character would avoid objects because it could sense them.

FIGS. 5A–5E show illustrative configurations which can be used on the plug portions of accessory parts in order to uniquely code the parts so that each part can be recognized by the associated computer when the part is plugged into the toy body. Although five different configurations are illustrated, other arrangements, which will be apparent to those skilled in the art, will operate in a similar manner to those illustrated in FIGS. 5A–5E.

Figure 5A:
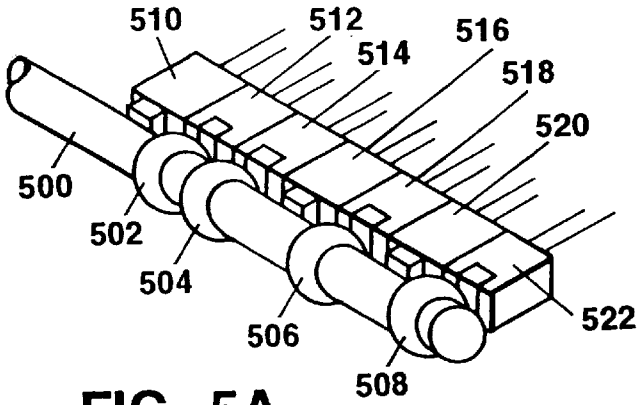
FIGS. 5A–5E illustrate various configurations on the plug portions of accessory parts illustrating how identification of the associated accessory part is accomplished.
Figure 5B:
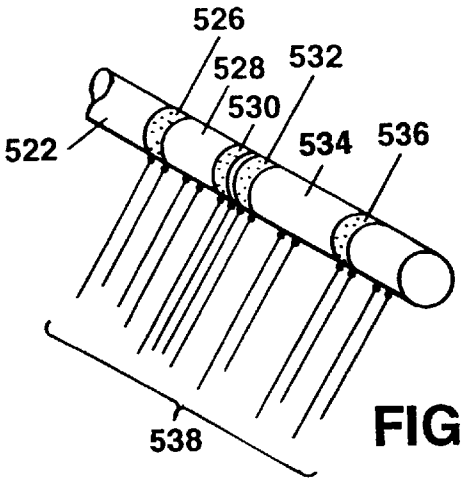

In FIG. 5A, the plug member 500 of an accessory part is provided with a plurality of toroidal rings 502–508 spaced along the longitudinal axis of the plug member. The longitudinal position of the toroidal rings can be used to code an identification number that represents a particular accessory part. When the plug member 500 is inserted into a socket, electrical switches 510–522, located in the wall of the socket, selectively contact the toroidal rings 502–508. Switches which the contact the rings are closed whereas switches that are located between the rings remain open. For example, as shown in FIG. 5A, switches 512, 514, 518 and 522 would be closed whereas switches 510, 516 and 520 would remain open. The opened or closed position of the switches can be detected by the associated computer and used to identify a particular accessory part.

Alternatively, a plug member 522 can be provided with a plurality of metalized rings 526, 530, 532 and 536 spaced along the longitudinal axis of the plug member 522. Located in the wall of the socket are a number of contacts 538 arranged in positions to selectively establish an electrical contact with the electrically conductive bands when the plug member is fully inserted into the socket. Due to the position of the conductive bands, some contacts will be electrically connected together and some will not establishing a coded number which identifies the accessory part.

Figure 5C:
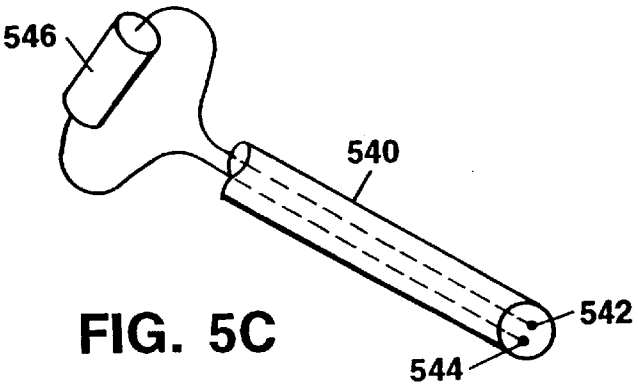

An alternative embodiment for an accessory part plug is illustrated in FIG. 5C. In this case, a plug member 540 is provided with two contacts 542 and 544 at the end, which is inserted into the toy body socket. Although two point contacts are illustrated in FIG. 5C, the contacts may assume other shapes, such as concentric circles. The bottom of the toy body socket contains two contacts that establish an electrical contact with the plug member contacts 542 and 544. An electrical component, such as a resistor 546, is connected between the contacts 542 and 544 and embedded in the accessory part. When electrical contact is established to contacts 542 and 544, the computer can read a value of the electrical component 546. Different values of components, for example, different resistor ohm ratings, can be used to code different accessory parts.

Figure 5D:
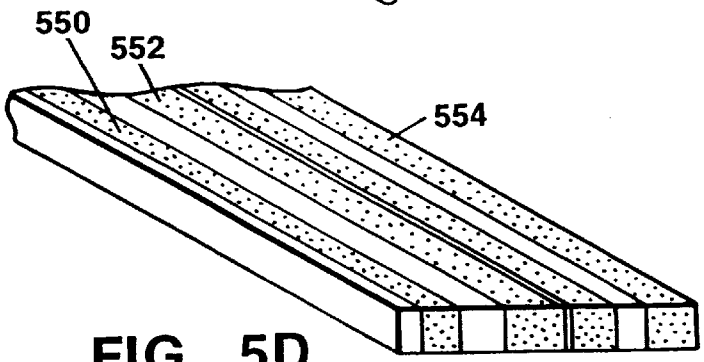

FIG. 5D shows yet another alternative embodiment in which a plug member 548 has a rectangular shape. Member 548 has a number of conductive stripes 550–554 which extend along the longitudinal axis of the plug member and "wrap around" the end. When the plug member 548 is inserted into a socket (not shown) in the toy body, electrically conductive stripes 550–554 contact electrical contacts located at the bottom of the socket. A sliding contact, which establishes contact with all stripes, can be used to apply a voltage to the stripes so that the voltage is selectively applied to the contacts in the socket. The position of the electrically conductive stripes 550–554 along the width of the plug member 548 is used to code an identification number that identifies the associated accessory part.

Figure 5E:
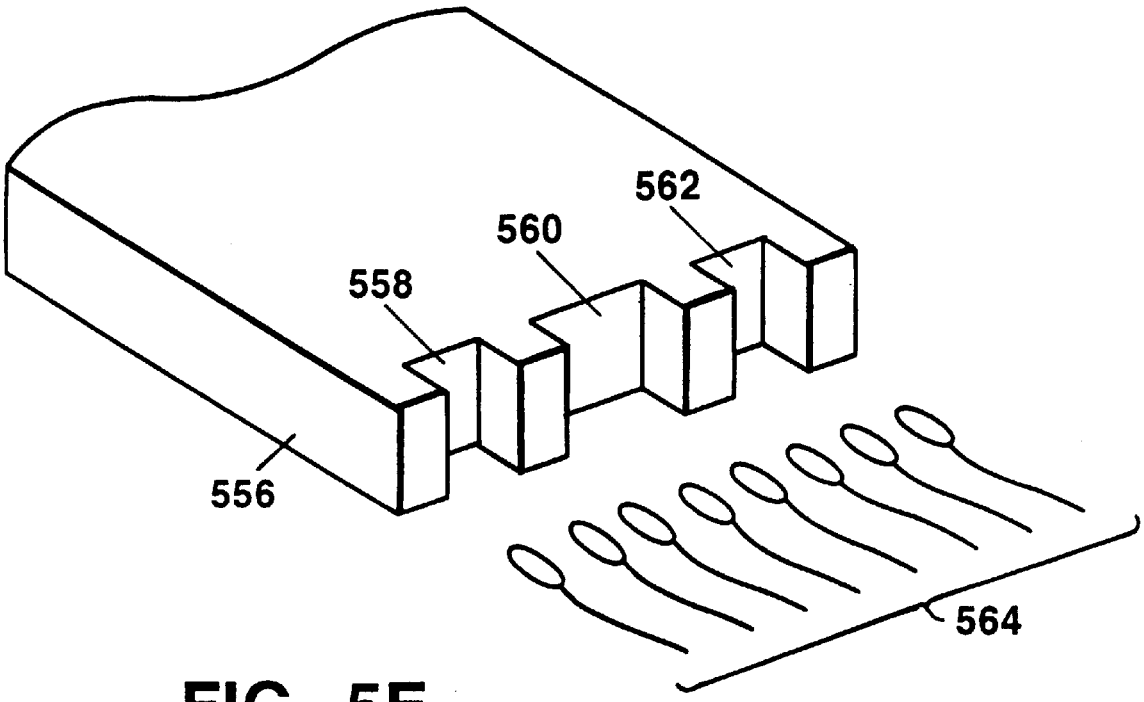

A further embodiment of an accessory part plug member is illustrated in FIG. 5E. In this embodiment, a plug member 556 is also rectangular. It has a plurality of notches 558–562 cut into the end which is inserted the toy body socket. The un-notched portions of the plug member 556 contact and close selected electrical switches 564 located at the bottom of the socket (not shown). The notches permit the plug member 556 to be inserted without contacting some switches. Switches that are not contacted remain open. The position of the notches 558–562 across the width of the plug member 556 establishes a coded number to identify the accessory part.

In an alternative embodiment, each accessory part could incorporate a special identification chip. This chip generates a special identification code that can be forwarded over a network to the computer system.

Figure 6A:
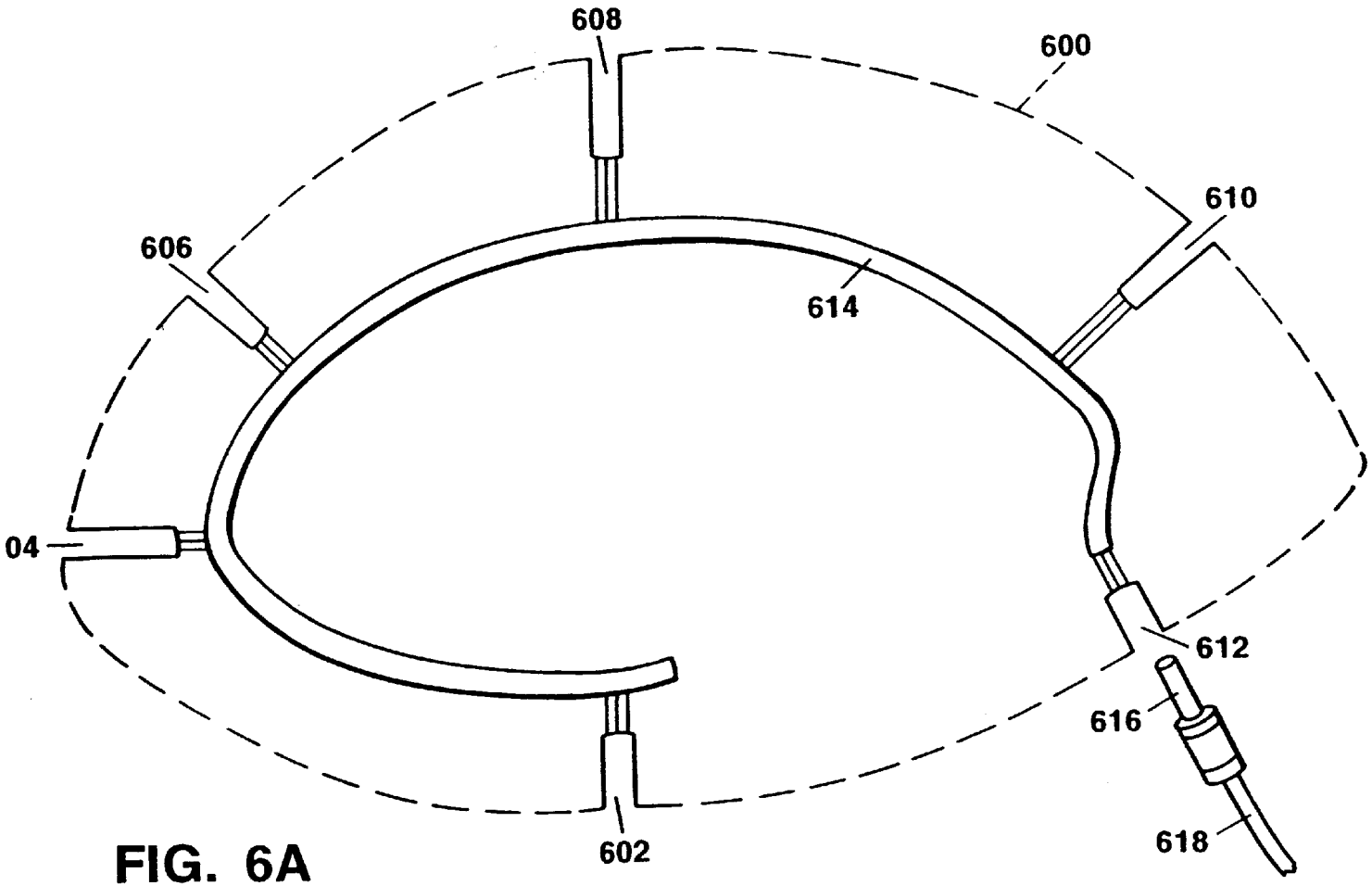
FIGS. 6A and 6B illustrate two embodiments of internal connections in a toy which allow the toy to recognize different accessory parts.

FIG. 6A is a cut away view of an illustrative toy body illustrating the internal construction and electrical contacts which allow a connected computer to interrogate various accessory parts to determine their characteristics. In particular, body 600 is provided, as previously described, with a plurality of sockets 602–612. Each of the sockets preferably has an identification mechanism, such as one of the mechanisms illustrated in FIGS. 5A–5E, which can identify the accessory part plugged therein. Use of the identification mechanisms illustrated in FIGS. 5A–5E, results in electrical signals that can be sensed by the computer. In particular, the electrical leads from the various switches or contacts in the identification mechanisms are connected, directly or indirectly, to a bus 614 which connects all of the sockets 602–612. Bus 614 may be a bus mechanism such as a one-wire MicroLAN™ bus constructed in accordance with specifications published by Dallas Semiconductor Corporation, 4401 South Beltwood Parkway, Dallas, Tex. 75244. Such a more sophisticated bus would allow two toy bodies to be plugged together such that information can be passed between the two bodies and the computer.

The toy body 600 can be connected to the computer by means of a plug 616 and a cable 618. In a preferred embodiment, plug 616 could be inserted into any of sockets 602–612. Alternatively, a special socket 612 may be designated for attachment to plug 616. In this case, the socket may have a particular shape or other mechanism that would indicate that the plug must be inserted into the socket.

Figure 6B:
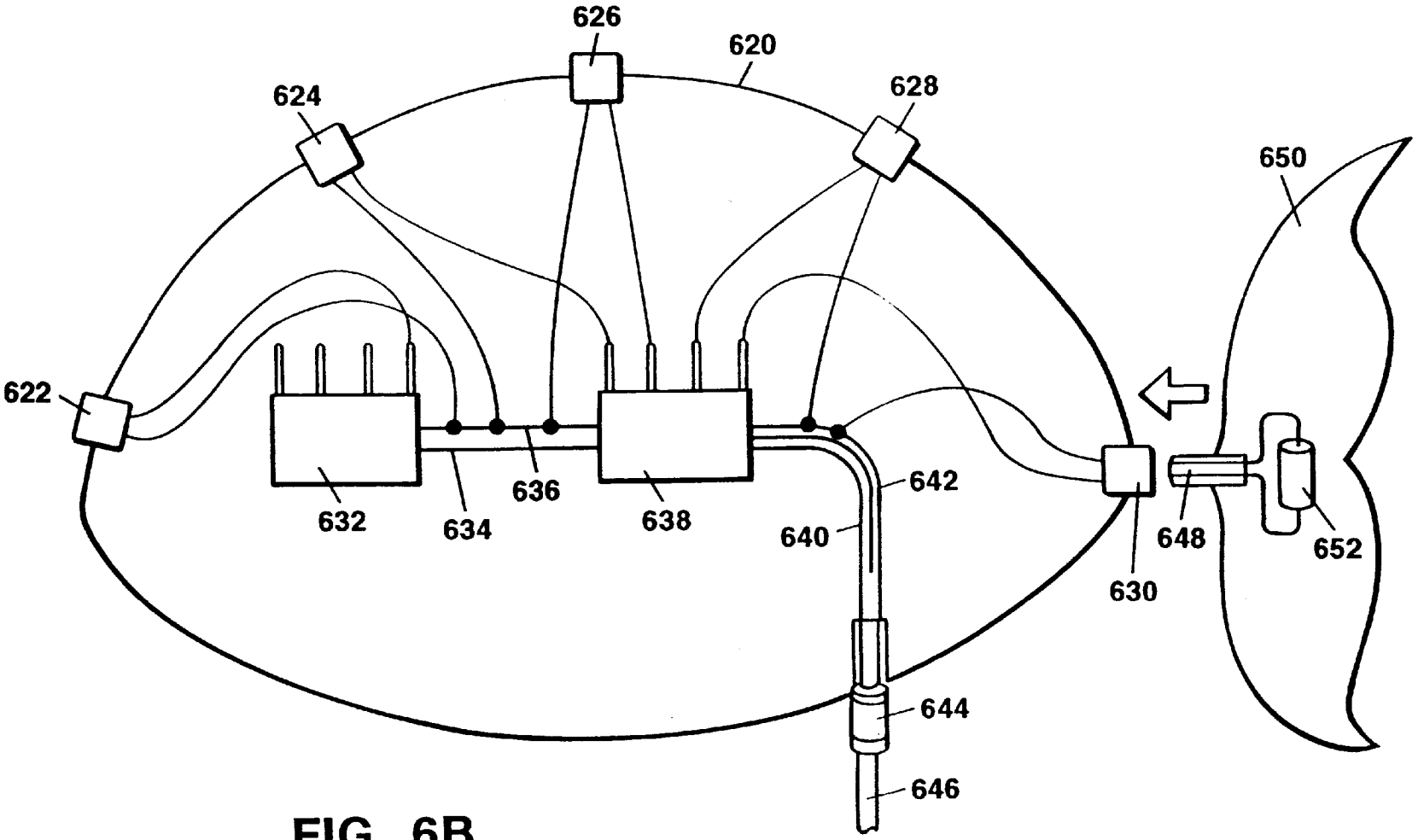

In accordance with another embodiment illustrated in FIG. 6B, the internal bus 614 can be eliminated. Instead, there is a separate A/D converter assigned to each socket. For example, units 632 and 638 in FIG. 6B each comprise four A/D converters. Socket 622 is assigned to one A/D converter in unit 632 whereas sockets 624, 626, 628 and 630 are assigned to converters in unit 638, respectively. The A/D converters themselves serve to identify the socket to which they are assigned because each A/D converter can be addressed individually.

Each A/D converter measures the voltage drop between a high-voltage source on leads 636 and 642 and ground on leads 634 and 640. Each accessory part has an electronic component embedded in it, which component has a predetermined value. For example a "fin" accessory part 650 might have a resistor 652 embedded in it. This resistor is connected to the A/D converter associated with socket 630 by means of plug 648. Plug 648 may have two wires that form the connection in a similar manner as that discussed with respect to FIG. 5C.

The resistor 652 forms a voltage divider with the associated A/D converter that produces a voltage drop from the supply voltage and this voltage drop appears across the A/D converter. The resistance value is effectively measured by the associated A/D converter and the measured value is read by the application software discussed below and converted to an accessory part ID using a table that maps measured resistance values to part IDs. When there is no part in the socket, there is a gap, so the resistance is infinite.

In the particular embodiment illustrated in FIG. 6B, the converter units 632 and 638 are connected in parallel with a common high-voltage source and a common ground. The units communicate with the computer system via digital signals transmitted on the supply lines 636 and 642. The units 632 and 638 may illustratively be 1-wire™ devices for use with the aforementioned MicroLAN technology developed and marketed by the Dallas Semiconductor Corporation. Other similar arrangements can also be used without departing from the spirit and scope of the invention.

Figure 7C:
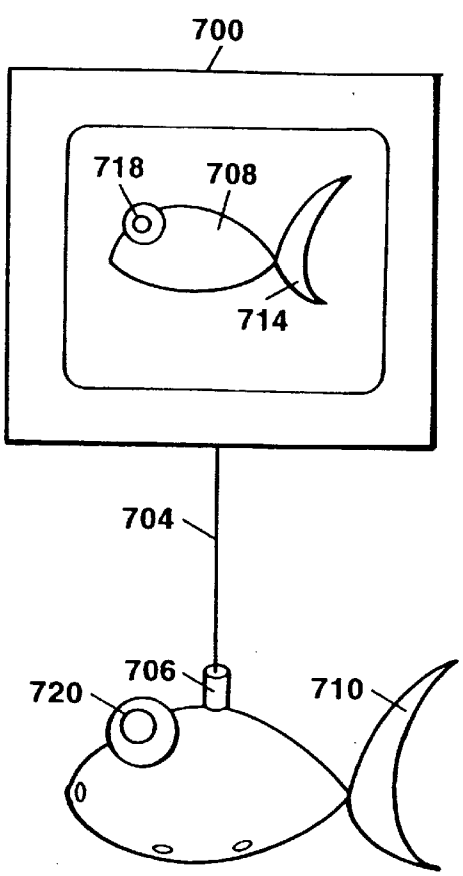
FIGS. 7A–7C illustrate how the graphical character representation on the computer display screen changes as accessory parts are added to or removed from the toy body.
Figure 7B:
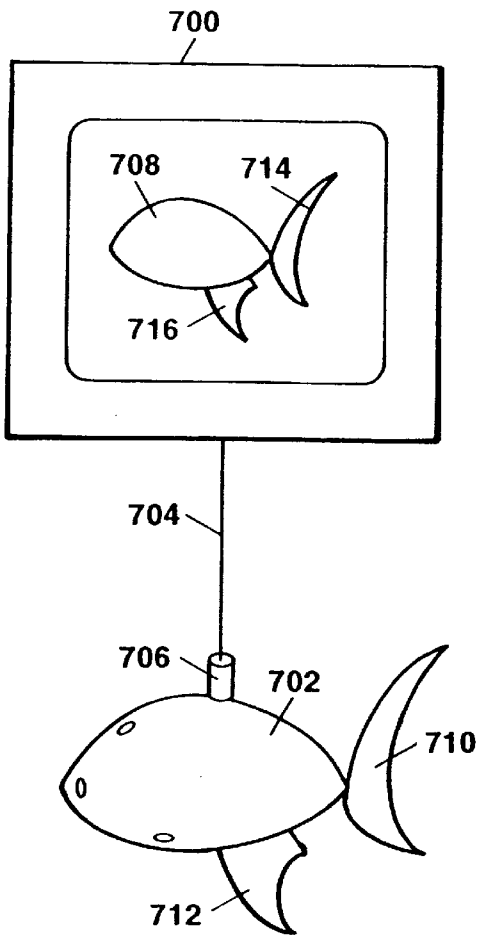
Figure 7A:
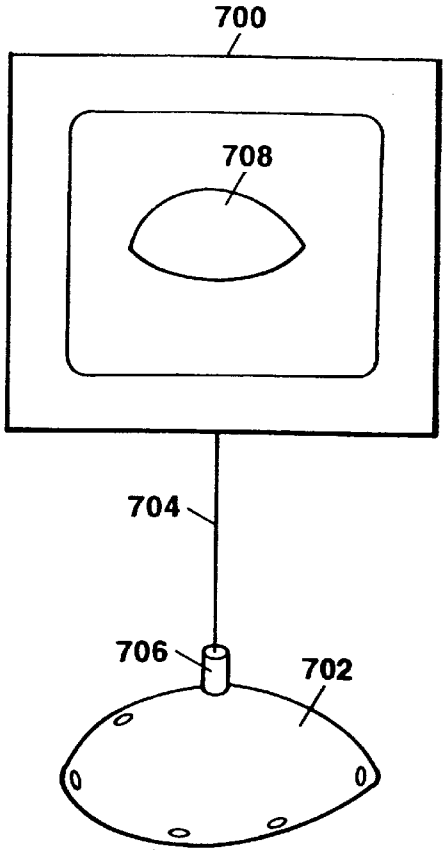

FIGS. 7A–7C illustrate how a virtual character is generated on the computer display screen as the associated physical toy is manipulated by a user. For example, in FIG. 7A, a toy body 702 is shown connected by means of a cable 704 and plug 706 to a computer represented by display screen 700. The computer recognizes that a toy body has been connected by sensing the body, via cable 704 and 706. In response, the computer generates a graphic illustration representative of the computer body 702 as illustrated by picture 708. In accordance with the invention, the software program operating in the computer causes the virtual character represented by the graphic drawing to interact with the virtual environment created by the computer. Since only the body is present, the body 708 would simply sit motionless on the screen until the user added further accessory parts.

In FIG. 7B, the user has added fins 710 and 712 to the toy body 702 to create a fish character. Since the plug members of each of the accessory parts 710 and 712 are coded as previously described, the computer can detect, via cable 704 and plug 706, the characteristics and location on the toy body of the accessory parts. In response, the computer draws fins 714 and 716 on the graphic illustration of the body 708 on the computer display screen 700. The added parts have the same shape and appearance as the actual physical parts 710 and 712. In addition, when the fins are added, the computer causes the composite fish character consisting of body 708, fin 714 and fin 716 to interact with the virtual environment. For example, the fish character might begin to swim in a manner based on the characteristics of the fins 714 and 716. The fish character may also interact with other characters that appear on the display screen which are drawn and controlled by the computer.

In FIG. 7C, the user has further modified the physical fish toy. In particular, fin 712 shown in FIG. 7B has been removed and eye 720 has been added to the physical toy body. These actions result in the computer deleting the graphic depiction of the fin from the virtual character displayed on the display screen 700 and in an eye 718 being drawn on the graphic depiction of the fish character. These changes would allow the virtual character to "see" where it is going and avoid virtual objects in its environment as the character interacts with its virtual environment.

In a similar manner, the user can add and remove accessory parts to the toy body changing both the appearance and the interaction of the character dynamically on the screen.

This allows the user a much greater degree of control over the character behavior than would be possible with either joysticks or keyboards or other conventional control mechanisms.

Figure 8:
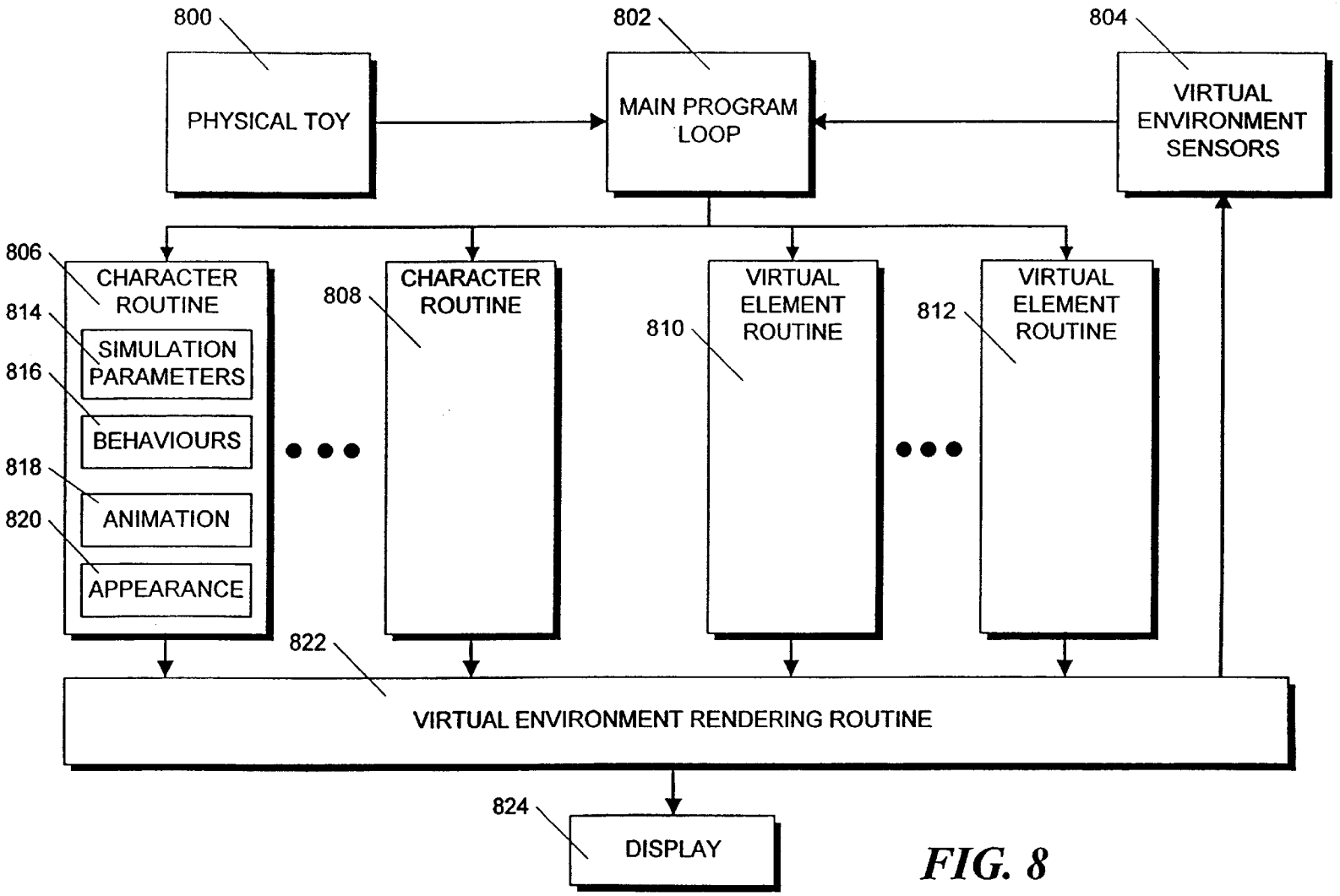
FIG. 8 is a block schematic diagram which illustrates data flow between different parts of the overall program.
Figure 9:
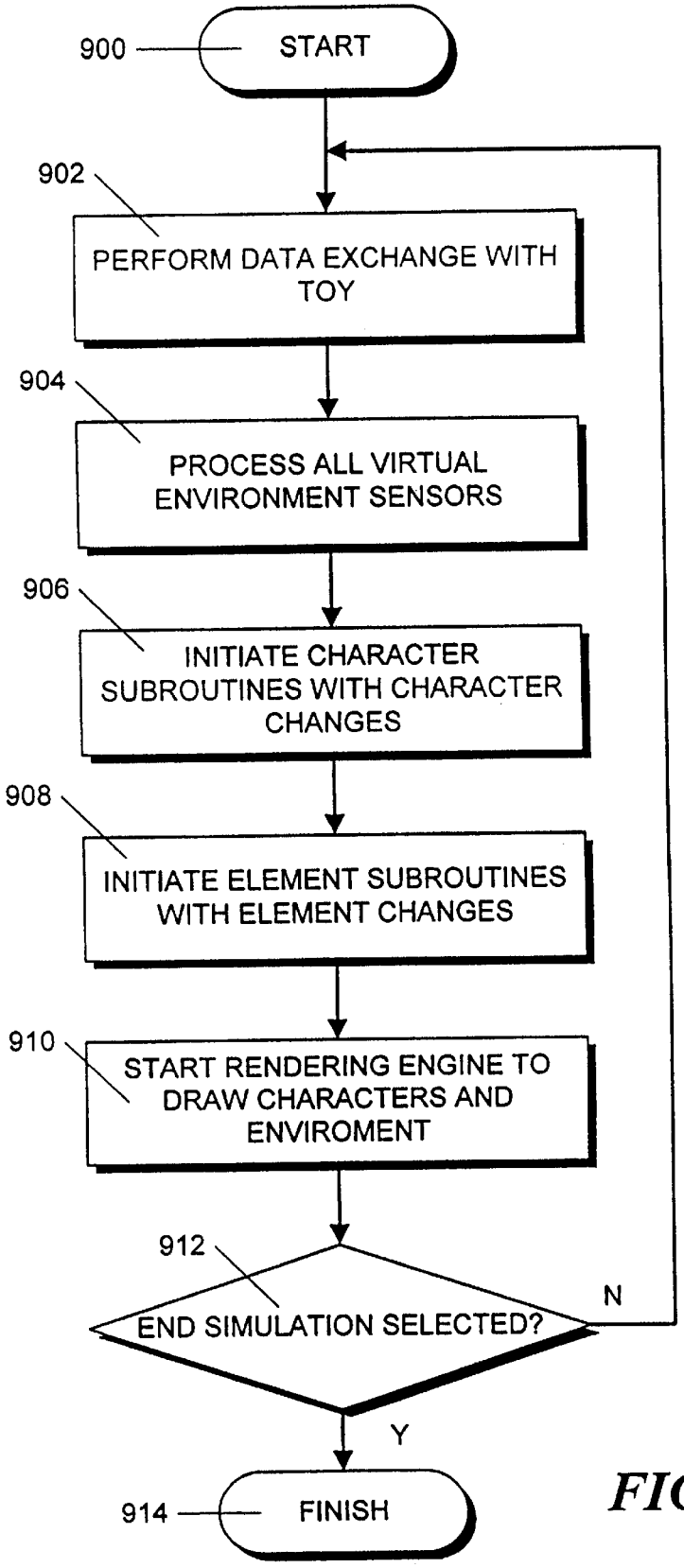
FIG. 9 is a flowchart which illustrates the overall operation of the main program loop running in the interactive computer application which senses accessory body parts plugged into the toy body.
Figure 10:
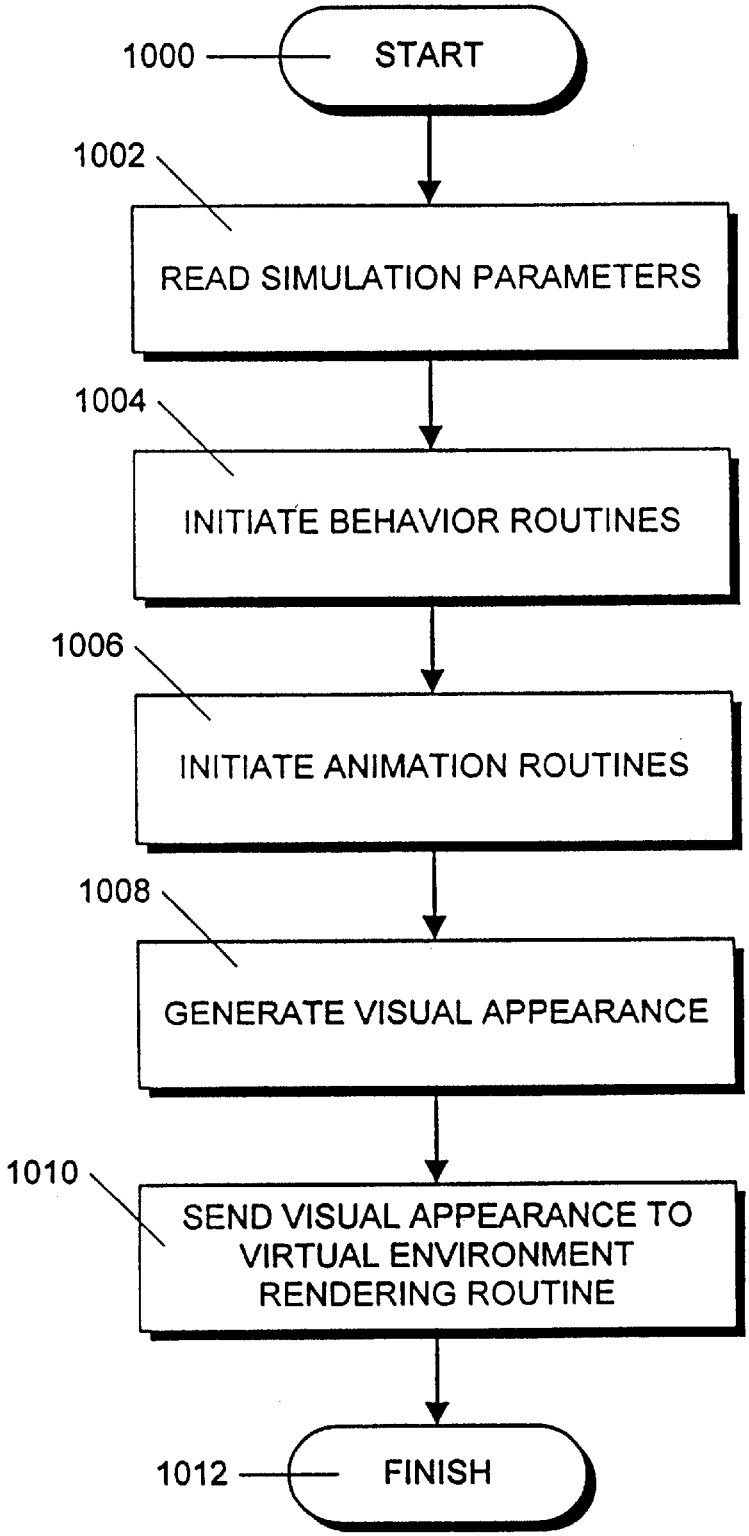
FIG. 10 illustrates a subroutine which models the behavior, and generates a graphic appearance, of a character or virtual element on the display screen.

FIG. 8 schematically illustrates data flow in a software program which interacts with the physical toy, generates the graphical character representation, creates the virtual environment and controls the interaction between the generated character and the virtual environment. FIGS. 9 and 10 are flowcharts that illustrate the operation of portions of the software program shown in FIG. 8. As simulation programs of this type are known, only the basic operation of the program will be described.

In FIG. 8, the main program loop 802 receives data from the physical toy 800 and also receives information from virtual environment "sensors" 804. The data from the toy could include, for example, data from internal switches or sensors, which data indicates the type and position of accessory parts plugged into the toy body, data from manipulation sensors on the toy indicating the user is moving an accessory part or data generated by a tilt sensor indicating that the user is moving the toy body.

The virtual environment "sensors" are actually software routines that generate outputs that are based on environmental elements or parameters. For example, one sensor might calculate a virtual "distance" between a particular character and another characters. Another sensor might calculate the presence of virtual "food" in the environment. Other sensors might calculate different environmental parameters. For example, if the virtual environment is an aquarium these environmental parameters could include water quality, temperature, etc. Other sensors calculate parameters for "elements" in the virtual environment. Such elements are non-character objects that may be animated. For example, in the case of an aquarium virtual environment, such elements could include treasure chests, divers, plants, food dispensers, etc. In general, there are "sensing" routines associated with each of the characters and each of the elements in the virtual environment which sensors monitor selected aspects of the characters and elements. The monitored values are then provided to the main program loop 802.

The main program loop 802, in turn, provides the environmental information to the character routines 806–808 and the virtual element routines 810–812. Although only two routines are illustrated, any number of routines may actually be present. Each of these routines controls the behavior and appearance of an associated character or virtual element in the virtual environment.

Each of the character routines, for example character routine 806, has a number of separate interconnected subroutines. In particular, each character routine bases its operation on a set of simulation parameters 814. These parameters can be provided by the main program loop 802 or provided by the user at the beginning of the simulation. If parameters are not provided default parameters are used. These default parameters are generally specific to a particular type of character.

The simulation parameters are applied to subroutines 816, which calculate the behavior of the particular character. The behavior is based on the type of character or element and, in the case of a physical toy, the accessory parts that are plugged into the toy body. In particular the behavior determines how the character or element will react to environmental parameters provided by the main program loop 802 based on the simulation parameters 814. Various reactions could include no response, a flight response, a fight response, an inquisitive response, etc. The behavior can include a "memory" so that a particular response, such as a fight response, might persist for a time that is predetermined by the simulation parameters.

Once a particular behavior is selected by the behaviors routines, the selected behavior (or behaviors) is used to drive animation routines 818 which calculate how various portions of the character move when performing the selected behavior. The animation routines might, for example, determine that various portions of the character, such as fins or a tail might move of change shape or that the character or element body itself might change shape.

The animation routines 818, in turn, control an appearance rendering routine 820 which generates the actual frame-by-frame character or element appearance of the character body and each of the body parts as specified by the animation routines 818.

The remaining character routines, such as routine 808, operate in a similar fashion. Similarly, the virtual element routines 810 and 812 also contain simulation parameters, subroutines that calculate behaviors, animation routines that animate the character based on the behaviors and an appearance rendering routine which generates appearance of the elements in each video frame.

The character routines, 806 and 808, and the virtual element routines, 810 and 812, provide the generated appearance outputs to the virtual environment rendering routine 822. This routine is triggered on a periodic basis by the main program loop 802 and graphically renders the entire virtual environment, including the characters and elements, for display on the display screen 824. The virtual rendering routine 822 also provides parameters to the virtual environment sensors 804 which sense the new character positions or element locations and behaviors calculated by the character routines 806 and 808 and the virtual element routines 810 and 812.

FIG. 9 is a flowchart that illustrates the operation of the main program loop 802. In particular, the routine illustrated in FIG. 9 starts in step 900 and proceeds to step 902 in which a data exchange is performed with the physical toy. As previously mentioned, this data exchange can be performed, for example, by reading the outputs of the analog-to-digital converters located within the body of the toy as shown in FIG. 6B.

Next, in step 904, the main program loop processes the virtual environment sensors 804 in order to obtain and filter the outputs. Next, in step 906, the main program loop initiates each of the character subroutines 806–808 passing in the environmental data detected by the virtual environment sensor output or by data exchange performed with the toy.

In step 908, the main loop initiates each of the virtual element subroutines passing in environmental data detected by the virtual environment sensor output. In step 910, the main program loop starts the rendering engine 822 in order to draw the virtual environment, including the characters.

A check is made in step 912 to determine whether the user has elected to end the simulation. If not, the routine proceeds back to step 902 to perform data exchange with the toy. If the user has elected to terminate the simulation, the routine proceeds to finish in step 914.

FIG. 10 illustrates the operation of an illustrative character or virtual element routine, for example, routine 806. In particular, the routine starts in step 1000 and proceeds to step 1002 in which the simulation parameters, which have been previously entered or determined from the main program loop are read. Next, in step 1004, the behavior routines are initiated using the simulation parameters to control the behavior routines.

In step 1006, the output of the behavior routines is used to initiate animation routines to determine the next move of the character. In step 1008, the animation routines drive the virtual appearance rendering routines in order to generate the new virtual appearance of the object. In step 1010, this visual appearance is provided to the virtual environment rendering routine. The character routine then finishes in step 1012.

A software implementation of the above-described embodiment may comprise a series of computer instructions either fixed on a tangible medium, such as a computer readable media, e.g. a diskette, a CD-ROM, a ROM memory, or a fixed disk, or transmissible to a computer system, via a modem or other interface device over a medium. The medium either may be a tangible medium, including, but not limited to, optical or analog communications lines, or may be implemented with wireless techniques, including but not limited to microwave, infrared or other transmission techniques. It may also be the Internet. The series of computer instructions embodies all or part of the functionality previously described herein with respect to the invention. Those skilled in the art will appreciate that such computer instructions can be written in a number of programming languages for use with many computer architectures or operating systems. Further, such instructions may be stored using any memory technology, present or future, including, but not limited to, semiconductor, magnetic, optical or other memory devices, or transmitted using any communications technology, present or future, including but not limited to optical, infrared, microwave, or other transmission technologies. It is contemplated that such a computer program product may be distributed as a removable media with accompanying printed or electronic documentation, e.g., shrink wrapped software, pre-loaded with a computer system, e.g., on system ROM or fixed disk, or distributed from a server or electronic bulletin board over a network, e.g., the Internet or World Wide Web.

Although an exemplary embodiment of the invention has been disclosed, it will be apparent to those skilled in the art that various changes and modifications can be made which will achieve some of the advantages of the invention without departing from the spirit and scope of the invention. For example, it will be obvious to those reasonably skilled in the art that, although the description was directed to a particular hardware system and operating system, other hardware and operating system software could be used in the same manner as that described. For example, although the toy is illustrated as interacting with a virtual environment in a single computer, it is also possible to connect several such computers together over a network such as the Internet. In this case, characters generated by each computer would appear on the screens of other computers so that the characters could interact. Other aspects, such as the specific instructions utilized to achieve a particular function, as well as other modifications to the inventive concept are intended to be covered by the appended claims.

What is claimed is:

1. An interactive game apparatus for use with a computer system having a display screen, the game apparatus comprising:

a plurality of physical parts from which parts can be selected and assembled together to construct a toy assembly;

a character creation mechanism in the computer for creating a virtual character having behavioral characteristics based on the parts constituting the toy assembly;

a display mechanism for displaying on the display screen a graphic character representation which resembles the toy assembly; and a mechanism operating in the computer which is responsive to each part added to, or removed from, the toy assembly, for dynamically modifying the behavioral characteristics of the virtual character and the graphic character representation.

2. Apparatus according to claim 1 further comprising an environment creator in the computer which creates a virtual environment with which the virtual character can interact.

3. Apparatus according to claim 1 further comprising a mechanism operating in the computer which is responsive to an identification of each part added to, or removed from, the toy assembly, for dynamically modifying the interaction of the virtual environment and the virtual character.

4. Apparatus according to claim 1 wherein each of the plurality of parts comprises a mechanism for attaching the part to the toy assembly.

5. Apparatus according to claim 4 wherein the attaching mechanism comprises a device for identifying the part to the dynamic modification mechanism.

6. Apparatus according to claim 1 wherein at least one of the parts comprises a sensor for sensing physical manipulation of the part.

7. Apparatus according to claim 6 further comprising a mechanism which cooperates with the sensor for controlling the virtual character.

8. Apparatus according to claim 1 further comprising a second plurality of physical parts from which parts can be selected and assembled together to construct a second toy assembly and means for connecting the toy assembly to the second toy assembly.

9. Apparatus according to claim 8 further comprising a device for identifying parts in the toy assembly and the second toy assembly to the dynamic modification mechanism.

10. Apparatus according to claim 1 wherein the toy assembly comprises a toy body and a plurality of accessory parts.

11. A method for playing an interactive game for use with a computer system having a display screen, the method comprising:

(a) providing a plurality of physical parts from which parts can be selected and assembled together to construct a toy assembly;

(b) creating a virtual character having behavioral characteristics based on the parts constituting the toy assembly;

(d) displaying on the display screen a graphic character representation which resembles the toy assembly; and (e) dynamically modifying the behavioral characteristics of the virtual character and the graphic character representation in response to each part added to, or removed from, the toy assembly.

12. A method according to claim 11 further comprising:

(f) creating a virtual environment with which the virtual character can interact.

13. A method according to claim 11 further comprising:

(g) dynamically modifying the interaction of the virtual environment and the virtual character in response to an identification of each part added to, or removed from, the toy assembly.

14. A method according to claim 11 wherein step (a) comprises:

(a1) attaching each of the plurality of parts to the toy assembly with an attaching mechanism.

15. A method according to claim 14 wherein step (a1) comprises identifying the part to a dynamic modification mechanism in the computer.

16. A method according to claim 11 wherein at least one of the parts comprises a sensor for sensing physical manipulation of the part.

17. A method according to claim 16 further comprising controlling the virtual character with a mechanism which cooperates with the sensor.

18. A method according to claim 11 further comprising:

(h) selecting parts from a second plurality of physical parts and assembling the selected parts together to construct a second toy assembly; and (i) connecting the toy assembly to the second toy assembly.

19. A method according to claim 11 further comprising identifying parts in the toy assembly and the second toy assembly to a dynamic modification mechanism in the computer.

20. A method according to claim 11 wherein the toy assembly comprises a toy body and a plurality of accessory parts.

21. A computer program product for use with an interactive game apparatus having a plurality of physical parts from which parts can be selected and assembled together to construct a toy assembly and a computer system having a display screen, the computer program product comprising a computer usable medium having computer readable program code thereon, including:

program code for creating a virtual character having behavioral characteristics based on the parts constituting the toy assembly;

program code for displaying on the display screen a graphic character representation which resembles the toy assembly; and program code which is responsive to each part added to, or removed from, the toy assembly, for dynamically modifying the behavioral characteristics of the virtual character and the graphic character representation.

* * * * *